US010669680B2

(12) United States Patent
Bauer et al.

(10) Patent No.: US 10,669,680 B2
(45) Date of Patent: Jun. 2, 2020

(54) METHOD FOR INSTALLING A TENSIONING ELEMENT IN AN ANCHOR BLOCK, HOLDER, IN PARTICULAR FOR CARRYING OUT THE METHOD AND COMBINATION OF A HOLDER WITH A PRESTRESSING ELEMENT

(71) Applicant: DYWIDAG-Systems International GmbH, München (DE)

(72) Inventors: Michael Bauer, Unterschleißheim (DE); Werner Brand, Freising (DE); Hagen Keiner, Freising (DE)

(73) Assignee: DYWIDAG-SYSTEMS INTERNATIONAL GMBH, München (DE)

( * ) Notice: Subject to any disclaimer, the term of this patent is extended or adjusted under 35 U.S.C. 154(b) by 0 days.

(21) Appl. No.: 16/470,634

(22) PCT Filed: Dec. 15, 2017

(86) PCT No.: PCT/EP2017/083012

§ 371 (c)(1),
(2) Date: Jun. 18, 2019

(87) PCT Pub. No.: WO2018/114664

PCT Pub. Date: Jun. 28, 2018

(65) Prior Publication Data

US 2019/0323184 A1 Oct. 24, 2019

(30) Foreign Application Priority Data

Dec. 19, 2016 (DE) ..... 10 2016 225 416

(51) Int. Cl.
*E01D 19/16* (2006.01)
*E01D 21/00* (2006.01)

(52) U.S. Cl.
CPC ..... *E01D 21/00* (2013.01); *E01D 19/16* (2013.01)

(58) Field of Classification Search
CPC ..... E01D 19/16; E01D 21/00
(Continued)

(56) References Cited

U.S. PATENT DOCUMENTS 2,311,241 A * 2/1943 Martin ..... E01D 19/14 14/21
4,633,540 A * 1/1987 Jungwirth ..... E04C 5/122 14/21

(Continued)

FOREIGN PATENT DOCUMENTS

DE 2103192 12/1972
DE 2549299 5/1977

(Continued)

OTHER PUBLICATIONS

International Search Report filed in PCT/EP2017/083012 dated Jun. 20, 2018.
German Search Report dated Oct. 30, 2017.

*Primary Examiner* — Raymond W Addie
(74) *Attorney, Agent, or Firm* — Rankin, Hill & Clark LLP

(57) ABSTRACT

A method for installing a prestressing element in an anchor block, in which the prestressing element is attached to a holder, includes the holder being moved to the anchor block, the prestressing element being introduced into a through-opening of the anchor block, and the prestressing element being fixed to the anchor block. The holder can be attached to the prestressing element at a distance which is selected so that the length of the projection of the prestressing element on the side of the holder facing the anchor block is greater than the length of a portion of the prestressing element, (Continued)

which is required for introducing the prestressing element into the through-opening and fixing the prestressing element to the anchor block.

15 Claims, 4 Drawing Sheets

(58) Field of Classification Search
USPC ..... 14/21, 22, 77.1
See application file for complete search history.

(56) References Cited

U.S. PATENT DOCUMENTS 5,461,743 A 10/1995 Stubler
5,803,641 A * 9/1998 Nutzel ..... E01D 19/16 14/22
5,896,609 A * 4/1999 Lin ..... E01D 11/04 14/18
6,578,328 B2 * 6/2003 Bournand ..... E01D 19/14 14/21
6,785,925 B1 * 9/2004 Donaldson ..... E01D 11/04 14/18
6,880,193 B2 * 4/2005 Figg, Jr. ..... E01D 19/14 14/21
7,003,835 B2 * 2/2006 Figg ..... E01D 19/14 14/21
7,478,450 B2 * 1/2009 Fong ..... E01D 11/04 14/20
8,001,852 B2 * 8/2011 Laurent ..... E01D 19/16 73/862.451
2005/0055974 A1 3/2005 Lecinq
2009/0158535 A1 * 6/2009 Adrian ..... E01D 19/14 14/21
2015/0052694 A1 * 2/2015 Kawabata ..... E01D 11/04 14/77.1

FOREIGN PATENT DOCUMENTS

DE 3810323 4/1989
JP 2010-261150 11/2010

* cited by examiner

METHOD FOR INSTALLING A TENSIONING ELEMENT IN AN ANCHOR BLOCK, HOLDER, IN PARTICULAR FOR CARRYING OUT THE METHOD AND COMBINATION OF A HOLDER WITH A PRESTRESSING ELEMENT

The invention relates to a method for installing a tensioning element in an anchor block, comprising the steps of:

attaching the tensioning element to a mount, moving the mount towards the anchor block, inserting the tensioning element into a through-opening in the anchor block, and fastening the tensioning element to the anchor block.

Such a method is used when erecting structures, for example, such as cable-stayed bridges, which comprise a plurality of tendons, each of which in turn comprises a plurality of tensioning elements that are received in a common tendon duct that may be made of high-density polyethylene (HDPE), for example. The method is used to pull the tensioning elements into the tendon duct and to then anchor them in the anchor block.

As is known per se from the prior art, the tensioning elements used according to the invention can each comprise a strand that is made up of a plurality of wires. For example, the strand can be made up of seven steel wires. In order to be able to provide a first corrosion-protection measure, the strands can be galvanised and/or coated with epoxy resin. Another corrosion-protection measure can involve the strands being sheathed by a protective cover, which is made of plastics material, in particular polyethylene (PE), for example. Before the strand is sheathed by the protective cover, the strand can be coated with a corrosion-protection material, for example wax or fat, which preferably fills substantially all of the intermediate space between the strand and the protective cover.

In order to install a tensioning element, the mount is usually attached to the free end of the tensioning element. For this purpose, the middle wire of the strand can be exposed and a middle wire clamp can be attached thereto. Alternatively, the free end of the middle wire can, however, also be plastically deformed to form a small upset head, on which the mount can interlockingly engage, whilst the outer wires of the mount are adjacently removed. A traction rope attached to the mount is then pulled in by means of a winch such that the tensioning element is moved towards the anchor block together with the mount. Upon reaching the anchor block, two alternatives are possible:

either the traction rope already extends through the through-opening in the anchor block, in which the tensioning element is intended to be anchored. In this case, the tensioning element together with the mount attached thereto still has to be pulled through the through-opening and then the tensioning element has to be fastened to the anchor block. For this approach, the size of the mount is limited, since it has to fit through the through-opening in the anchor block together with the tensioning element. It is easy to see that this involves restrictions with respect to the fastening stability. Furthermore, the traction rope must be threaded back through the particular through-opening for each installation process, which makes the overall method more complex, or the tensioning element is wound on an additional winch, the traction rope of which has been pulled through the associated through-opening in the anchor block whilst the tensioning element was simultaneously moved towards the anchor block. However, this procedure requires another winch and at least the last part of the installation process is also subjected to the same restrictions with regard to the stability of the connection between the mount and the tensioning element as the above-described procedure.

An object of the present invention is therefore to simplify the installation of tensioning elements.

This object is achieved according to the invention by a method of the type in question, in which the mount is attached to the tensioning element at a spacing that is selected such that the length of the projection of the tensioning element, which is created by this spacing, on the side of the mount that is nearer to the anchoring is at least as long as the length of a portion of the tensioning element that is required in order to insert the tensioning element into the through-opening in the anchor block and to fasten the tensioning element to the anchor block.

This makes it possible for the tensioning element to be inserted into the through-opening in the anchoring without the mount having to be released from the tensioning element in order to wrap said tensioning element around another winch, and without having to re-guide the mount together with the traction rope connected thereto through the associated through-opening in the anchor block for each installation process. In addition, the dimensions of the through-opening in the anchor block do not need to be taken into consideration when designing the mount, since, according to the invention, only the portion of the tensioning element that is arranged on the far side of the mount, i.e. the projection of the tensioning element, is guided through the through-opening. This simplifies the installation method in terms of the time, personnel and equipment required to carry it out.

According to the invention, the mount can also be moved towards the anchor block by means of a traction rope.

A traction rope can advantageously be arranged on both the end of the mount that is nearer to the anchor block and the end of the mount that is further away from the anchor block, a separate winch preferably being assignable to each of the two traction ropes. This development allows the mount to be moved back and forth in a controlled manner between a tensioning element starting position, which can be on the bridge deck of the cable-stayed bridge or at the level of the foundations of a tower, for example, and the anchor block, which can be in the pylon of the cable-stayed bridge or at the level of the steeple, for example, for example a controlled forward and back movement in the tendon duct of the tendon. In this case, it is also advantageous for the winch assigned to the tensioning element starting position to be operated such that the traction ropes are tensioned substantially continuously whilst the mount is moved towards the anchor block.

One problem that often arises as the tensioning element moves towards the anchor block, and specifically, but not exclusively, due to the tensile loading of the traction ropes, is that the tensioning element connected to the mount twists around its longitudinal extension direction, for example. Since in practice it is not uncommon for tendons to comprise a large number of tensioning elements, for example more than a hundred tensioning elements, the tendon ducts have an internal diameter that is considerably larger than the diameter of the individual tensioning elements. Therefore, twisting of the tensioning element that has just moved towards the anchor block, in particular at the beginning of the installation process of the tendon when a few tensioning elements are still received in the tendon duct, can lead to the free end of the tensioning element, i.e. in particular the free end of the projection, getting stuck in the tensioning elements that are already received in the tendon duct. In order to be able to prevent this problem, in a development of the invention a guide unit is attached to the free end of the tensioning element, at least whilst the mount is being moved towards the anchor block. The mere fact that the guide unit is attached to the free end of the tensioning element and therefore extends therebeyond transversely to the longitudinal extension direction of the tensioning element makes it harder for the tensioning element to get caught in other tensioning elements received in the tendon duct. This is all the more applicable when the dimensions of the guide unit transversely to the longitudinal extension direction of the tensioning element are more than twice as large as those of the tensioning element itself.

In addition or alternatively, however, the guide unit can also be connected, for example releasably connected, to the traction rope. In this case, the connection can be formed by an eyelet, for example, which loosely surrounds the traction rope such that said eyelet can move relative to the traction rope. In this case, the releasability can be provided in the form of a karabiner or the like, for example. However, it is also conceivable for the connection to be formed by a clamp that can be fastened to the traction rope such that it cannot move relative thereto.

In order to be able to install the tensioning elements more effectively, the mount is designed for the attachment of at least two tensioning elements. In this way, a plurality of tensioning elements can be moved from the tensioning element starting position to the anchor block at the same time in one operation. In this case, care only needs to be taken to ensure that each of the tensioning elements is inserted into the respectively assigned through-opening in the anchor block. However, this can be ensured by simply numbering the tensioning elements or providing them with a coloured marking, for example.

In principle, it is conceivable for the projections of the at least two tensioning elements to be of different lengths. This would make it possible for the tensioning elements to be inserted into the associated through-holes one after the other. This may be advantageous in particular for confined spaces. However, in order to achieve as short an installation time as possible, according to the invention it is preferable for the projections of the at least two tensioning elements to be substantially the same length. This makes it possible to insert the tensioning elements into the through-openings in the anchor block at the same time, and to anchor them therein.

According to another aspect, the invention relates to a mount for a tensioning element, in particular for carrying out the method according to the invention, comprising:

- a main body comprising an elongate recess for receiving the tensioning element, the recess comprising an outlet at each of its two longitudinal ends, which is designed and intended to allow the tensioning element to enter the main body and to leave it again, and the recess comprising an elongate opening in one of its longitudinal sides, which comprises a substantially linear portion that extends over the entire length of the main body, and
- a holding-force generation device, which is intended to generate a holding force that presses the tensioning element against a boundary wall of the recess.

The mount according to the invention likewise contributes to simplifying the installation of the tensioning elements and therefore to achieving the object according to the invention. The particular tensioning element specifically only needs to be inserted into the recess from above through the substantially linear portion of the upper opening of the recess and then the holding-force generation device needs to be actuated. In this case, the projection of the tensioning element, which is required for carrying out the method according to the invention, can leave the mount through one of the outlets, while the remaining length of the tensioning element passes out of the other outlet. As a result of its actuation, the holding-force generation device generates a holding force, which securely holds the tensioning element in the mount while the mount is moved towards the anchor block together with the tensioning element.

In a development of the mount according to the invention, the holding-force generation device comprises an engagement element, which can move relative to the main body and is designed and intended to enter into bearing engagement with the tensioning element and to press said tensioning element, whilst bearing against it, against a fixed wall portion of the recess in the main body. In this case, the engagement element can, for example, be formed by a ram that can move relative to the main body and can in particular be moved with the aid of a tool, by hand or by means of a piece of force-exerting equipment. Alternatively, however, it is also conceivable for the engagement element to be formed by a surface portion of a flexible element, for example a hose or a balloon, which can be hydraulically and/or pneumatically filled and emptied.

While the tensioning element is pressed against a fixed wall portion of the recess in the main body so as to bear thereagainst, the tensioning element can also be displaced in the recess, at least in part. For example, the holding-force generation device can be designed to deflect the tensioning element out of its linear course. According to one embodiment of the mount, it is thus conceivable for a longitudinal portion of the tensioning element, which lies between the two outlets, to be bent into a substantially double-S shape. Should the simple double-S shape be insufficient for generating the holding force required, a shape having several double Ss can also be used. A corresponding number of engagement elements can be provided for this.

In a development of the mount according to the invention, the main body also comprises a cover wall, which covers the recess at least in portions and in a manner in which it is adjacent to the fixed wall portion, for example. This cover wall can interlockingly secure the tensioning element from accidentally automatically leaving the recess.

In order to be able to move more than one tensioning element towards the anchor block using the mount according to the invention, the mount also comprises at least two recesses according to the invention. For example, the mount can comprise two such recesses, which are arranged substantially mirror-symmetrically with respect to the longitudinal direction of the mount. In this case, a common holding-force generation apparatus can be assigned to the two recesses.

In this case, the common holding-force generation apparatus can comprise two engagement elements, each of which is intended to enter into bearing engagement with one of the tensioning elements and which can be moved by means of a common actuator. However, it is also possible for the common holding-force generation apparatus to comprise an engagement unit, which can be pivoted or rotated on the main body about an axis that extends in parallel with the vertical direction of said main body. In this case, two portions of the engagement unit can form one engagement element in each case, which is intended to enter into bearing engagement with one of the tensioning elements.

As regards the holding force, it shall be understood that the holding-force generation device and the tensioning element have to engage in a manner that prevents or completely rules out the risk of damage to the tensioning element or part of the tensioning element, for example the protective cover that sheaths the strand, irrespective of whether the holding force is generated by a friction fit and/or a positive fit.

With respect to a component of the holding force generated by a friction fit, care must be taken to ensure that the clamping force, i.e. the component of the holding force generated by the non-positive connection, only substantially elastically deforms the tensioning element, in particular the protective cover of the strand that forms the actual tensioning element. In particular, plastic deformation of the protective cover could lead to the formation of cracks, which could impair the protection of the strand against corrosion as a result of moisture entering through the cracks.

If a positive-fit component of the holding force is generated by retaining elements penetrating the protective cover of the strand that forms the actual tensioning element, care should be taken to ensure that said retaining elements do not permanently damage the protective cover. As a result of the openings in the protective cover, which are caused by damage of this kind, in particular moisture could penetrate the protective cover, which could lead to corrosion of the strand. For example, at least portions of the surface of the engagement element that is intended for bearing engagement with the tensioning element could be formed having a rough surface, the individual retaining projections that form the surface roughness protruding from the base of the surface by a spacing that is smaller than the thickness of the protective cover.

Since the protective cover usually fits tightly around the strand, for example in the form of heat-shrink tubing, the positive-fit component of the holding force can, however, also be generated by the surface of the engagement element intended for bearing engagement with the tensioning element being provided with a coating, which is shaped so as to match the surface of the tensioning element. However, in addition or alternatively, it is also possible for the coating to be elastically deformable such that it can adapt to the shape of the tensioning element surface. Furthermore, in order to increase the frictional contribution to the holding force, the coating can have a coefficient of static friction that is greater than that of the material from which the ram is made.

The surface of the main body, against which the tensioning element is pressed by means of the ram, can also be provided with a coating that has at least one of the properties outlined above for the coating for the ram.

Lastly, the invention also relates to the combination of a mount according to the invention with at least one tensioning element, in particular at least one tensioning element that comprises a strand that is made up of a plurality of wires and is sheathed by a protective cover.

The invention will be explained in more detail in the following on the basis of one embodiment and with reference to the accompanying drawings, in which.

Figure 1:
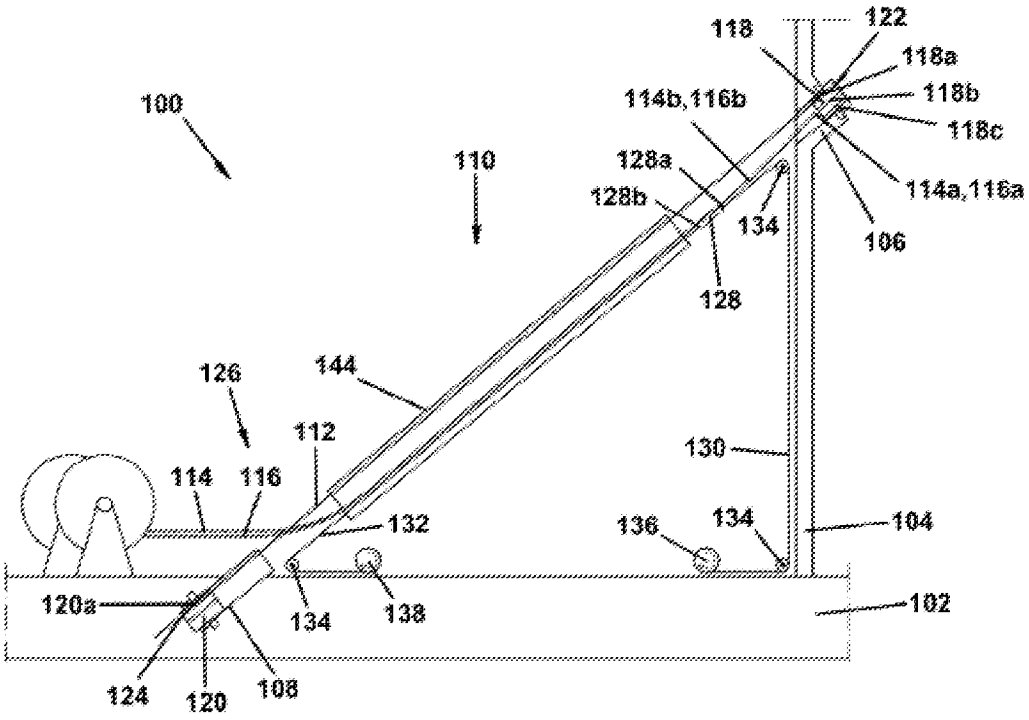
FIG. 1 is a schematic view of a cable-stayed bridge, whereby the method according to the invention and the mount according to the invention are used for the erection thereof.

In FIG. 1, a cable-stayed bridge, for which the method according to the invention can be used, is generally denoted by 100. It comprises a bridge deck 102, on which transport routes for motor vehicles and/or other vehicles and/or pedestrians may be arranged, for example, and at least one pylon 104. A traction rope 110 extends between an anchoring point 106 of the pylon 104 and an anchoring point 108 of the bridge deck 102.

Even though FIG. 1 only shows a single traction rope 110, it shall be understood that the cable-stayed bridge 100 can comprise a plurality of such traction ropes, and in the majority of cases, does. FIG. 1 only shows a single traction rope 110 for the sake of simpler presentation alone.

The traction rope 110 in turn comprises a plurality of strands, only three of which are shown in FIG. 1, that is strands 112, 114 and 116, for the sake of clearer presentation.

In this case, the strand 112 is already completely installed, i.e. it is anchored in both an anchor block 118 of the anchoring point 106 and in an anchor block 120 of the anchoring point 108. For this purpose, said strand passes through through-bores 118*a* and 120*a* in the anchor blocks 118 and 120 and is held therein by means of wedges 122 and 124, respectively.

In contrast, for this purpose the strands 114 and 116 are in the process of being transported from a starting position 126, which is arranged near to the anchoring point 108, to the anchoring point 106. For this purpose, the two strands 114 and 116 are inserted in a mount 128 and fastened thereto by means of clamps (see also FIG. 3). The way in which the strands 114 and 116 are fastened to the mount 128 will be explained in more detail below with reference to FIG. 3. Traction ropes 130 and 132 are fastened to the two longitudinal ends 128*a* and 128*b* of the mount 128 and extend to a first winch 136 and a second winch 138 over guide rollers 134. By correspondingly actuating the two winches 136 and 138, the mount 128 can be moved back and forth between the starting position 126 and the anchoring point 106 in a controlled manner.

The traction ropes 130 and 132 can be fastened to the longitudinal ends 128*a* and 128*b* of the mount 128 by means of swivels, for example, which comprise an axial joint.

The point at which the mount 128 is fastened relative to the free ends 114*a*, 116*a* of the strands 114, 116 is essential to the invention. Specifically, this point is selected such that the spacing d between the mount 128 and the free end 114*a*, 116*a* of the strands 114, 116 is greater than a free length of the strands, which is required to guide the strands through the through-bores 118*b* and 118*c* in the anchor block 118 (see FIG. 2) and to be able to anchor them there by means of the wedge 122. In this way, the two strands 114 and 116 can be transported to the anchoring point 106 until their free ends 114*a* and 116*a* are arranged directly in front of the anchor block 118. The transport speed of the strands 114 and 116 is then reduced by correspondingly actuating the winches 136 and 138 such that the free ends 114*a* and 116*a* of the strands can be threaded into the through-bores 118*b* and 118*c* by hand. If the free ends 114*a* and 116*a* protrude to a sufficient extent on the back of the anchor block 118, the winches 136 and 138 are halted in order to allow the installation personnel to anchor the strands 114 and 116 in the anchor block 118 by means of the wedge 122. Once the strands have been successfully anchored, the clamping engagement between the mount 128 and the strands 114 and 116 can be released such that, by correspondingly actuating the winches 136 and 138, the mount 128 can be moved back to the starting position 126 again, where it picks up the next pair of strands.

Figure 2:
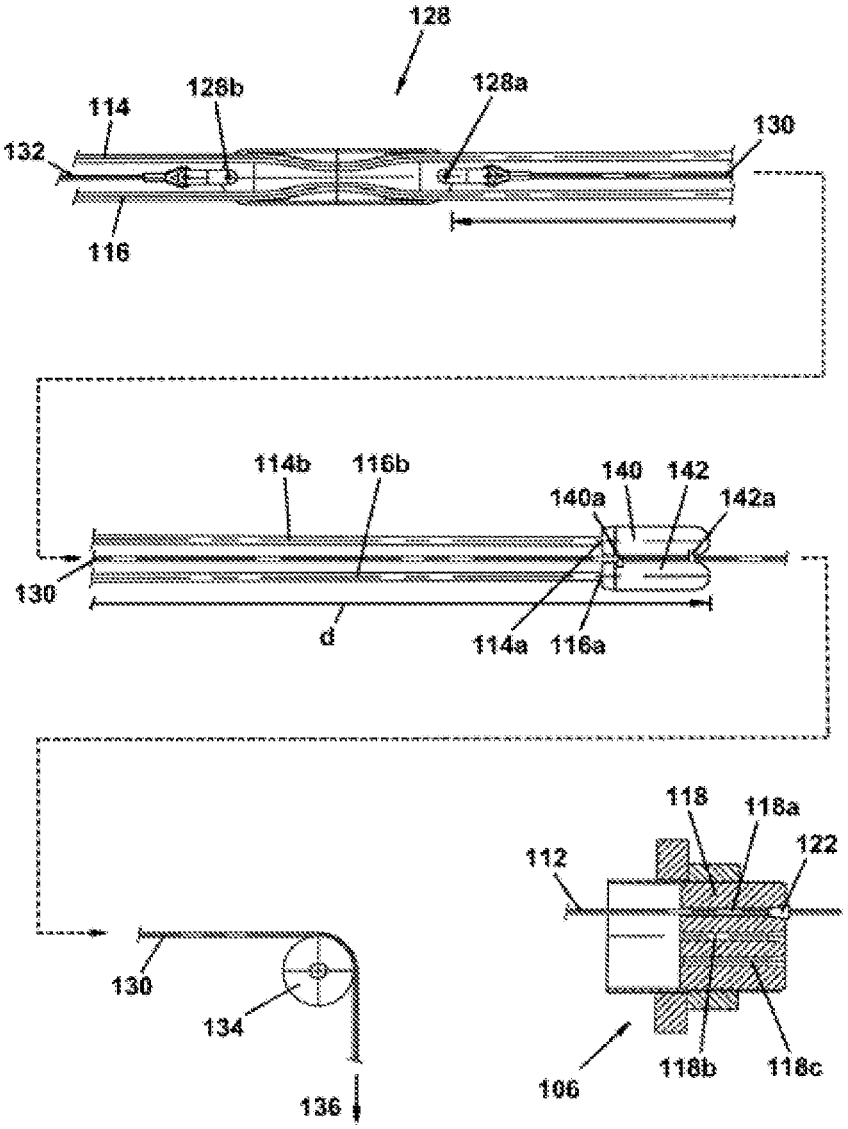
FIG. 2 is a schematic view explaining the interaction between the tensioning elements, the mount, the traction ropes and the anchor plate.

It must still be added that guide units 140 and 142 are arranged at the free ends 114*a* and 116*a* of the strands 114 and 116 (see FIG. 2). These guide units 140 and 142 have the task of safeguarding the free ends 114*a* and 116*a* of the strands 114 and 116 during transport to the anchoring point 106 against getting caught between strands that have already been installed as a result of their protrusion 114*b* and 116*b* beyond the mount 128. This risk is all the more significant since the strands 112, 114 and 116 are received in one tube 144, which is arranged between the two anchoring points 106 and 108, in order to protect the strands against external influences, in particular corrosion.

The two guide units 140 and 142 are advantageously releasably connected to the traction rope 130, the corresponding connecting points only being shown schematically in FIG. 2 at 140*a* and 142*a*.

When using such guide units 140 and 142, it is also advantageous for transport of the strands 114 and 116 to the anchoring point 106 to be paused if the free ends 114*a* and 116*a* of the strands 114 and 116 are directly in front of the anchor block 118, in order to allow the installation personnel to remove the guide units 140 and 142 from the strands 114 and 116.

Figure 3:
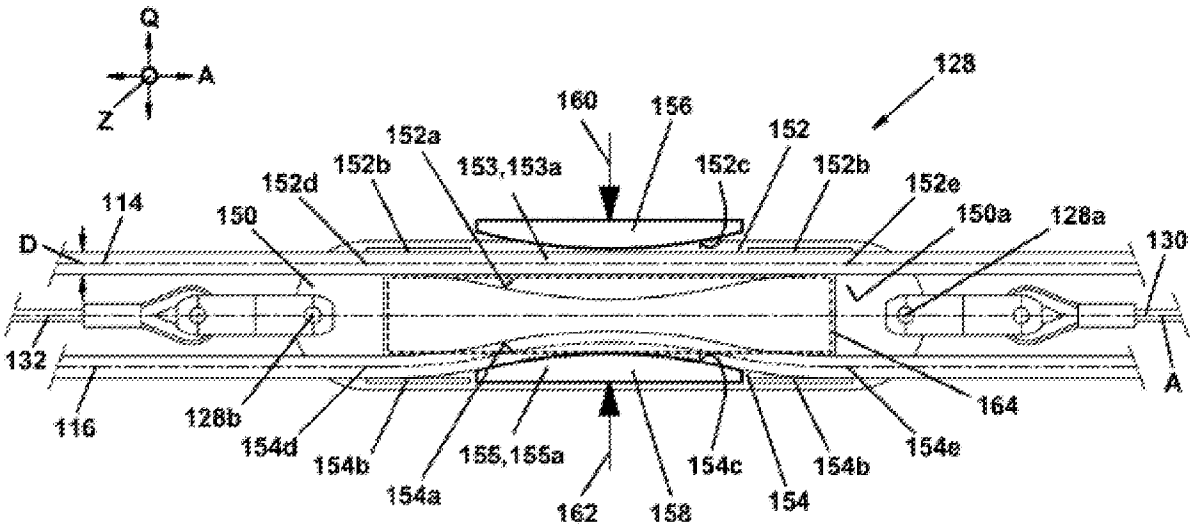
FIG. 3 is a plan view of a first embodiment of the mount according to the invention.

FIG. 3 shows a first embodiment of a mount 128 according to the invention. Said mount comprises a main body 150, which is mirror-symmetrical with respect to a longitudinal axis A and comprises two elongate recesses 152 and 154, which are open at the top and are designed and intended to receive the strands 114 and 116.

The recesses 152 and 154 are delimited in the direction of the longitudinal axis A by boundary walls 152*a* and 154*a* and are delimited by ridges 152*b* and 154*b* and surfaces 152*c* and 154*c* on their side that is further away from the longitudinal axis A, which are formed on rams 156 and 158. Furthermore, the strands 114 and 116 received in the recesses 152 and 154 rest against a surface 150*a* of the main body 150. Lastly, the recesses 152 and 154 comprise end-face openings 152*d* and 152*e* or 154*d* and 154*e*, respectively, at their two longitudinal ends. In the embodiment shown, the boundary walls 152*a* and 154*a* and the ridges 152*b* and 154*b* are attached to the main body 150 or integrally formed therewith.

The openings through which the strands 114 and 116 can be inserted into the recesses 152 and 154 are denoted in FIG. 3 by 153 and 155, respectively, and their linear portion is denoted by 153*a* and 155*a*, respectively.

As indicated in FIG. 3 by the arrows 160 and 162, the mount 128 also comprises holding-force generation means, by means of which the rams 156 and 158 act on the strands 114 and 116 in order to press said strands against the boundary wall at 152*a* and 154*a*. In this way, the strands 114 and 116 are clamped between the boundary walls 152*a* and 154*a* on one side and the rams 156 and 158 on the other side by a force that makes it possible to transport the strands 114 and 116 to the anchoring point 106 by means of the mount 128, without the strands 114 and 116 accidentally automatically releasing from the mount 128. Together with the respective rams 156 and 158, the holding-force generation means 160 and 162 form holding-force generation devices within the meaning of the claims.

The holding-force generation means 160 and 162 can be formed as actuating units that can be actuated mechanically and/or by means of an electric motor and/or electromagnetically and/or pneumatically and/or hydraulically. Irrespective of the way in which the actuating force is generated, a transmission can also be provided, which gears an input movement of the particular actuating unit down into an actuating movement of the rams 156 and 158.

For example, the holding-force generation means 160 and 162 can be formed by studs, which are received in a threaded hole in the main body 150 and press against the rams 156 and 158. In this case, the thread of the bolts is used to gear down the rotary input movement of the bolts, as just mentioned, into a translational actuating movement of the bolts and therefore acts as the transmission. However, it is also possible for the holding-force generation means 160 and 162 to be formed as inflatable hose elements, the surface portions of which that act on the strands 114 and 116 function as the rams 156 and 158.

It is also conceivable for a common actuating unit to be assigned to the two rams 156 and 158. The rams 156 and 158 could therefore be formed as cams, which are arranged on the outer circumference of a disc that is mounted on the main body 150 so as to be rotatable about an axis Z that extends orthogonally with respect to the longitudinal axis A and the transverse direction Q. In this case, just one actuating unit is sufficient to press the two rams 156 and 158 against the strands 114 and 116 at the same time by rotating the disc.

As shown in FIG. 3, both the boundary walls 152*a* and 154*a* and the surfaces 152*c* and 154*c* of the rams 156 and 158 are curved. In particular, the boundary walls 152*a* and 154*a* have a double-S shape when viewed in the direction of the longitudinal axis A. In this case, in the embodiments shown the lateral offset, i.e. the offset in the transverse direction Q, is substantially the same size as the diameter D of the strands 114 and 116. Furthermore, the main body 150 comprises a cover wall 164, which is shown by a dashed line in FIG. 3 and is arranged so as to cover those portions of the boundary walls 152*a* and 154*a* that are at the smallest spacing from the longitudinal axis A.

In this way, the strands 114 and 116 can be fastened to the mount 128 as follows:

As shown in FIG. 3 for the strand 114, the strands are first inserted into the associated recess, recess 152 in this case, extending linearly until they rest against the surface 150*a* of the main body 150. In this case, the strand 114 enters the recess 152 through the opening 152*d* and leaves the mount 128 again through the opening 152*e* at the other end thereof. The holding-force generation means 160 are then actuated such that the ram 156 applied on the side of the strand 114 and begins to press it against the boundary wall 152*a*. As a result, the linear course of the strand is bent into a double-S shape, which corresponds to the double-S shape of the associated boundary wall, in the immediate vicinity of the ram. This is shown in FIG. 3 for the example of the strand 116. In this state, the strand 116 engages under the cover wall 164 so that it is surrounded on all sides by the boundary wall 154*a*, the base 150*a*, the surface 154*c* of the ram 158 and the cover wall 164 and is therefore interlockingly held on the mount 128.

Figure 4:
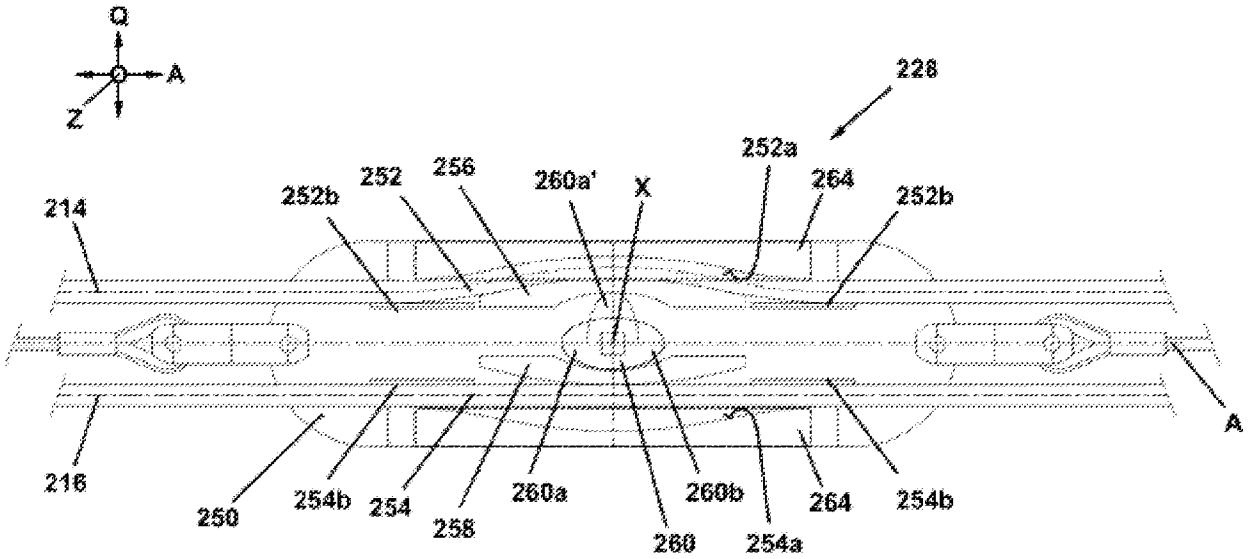
FIG. 4 is a plan view of a second embodiment of the mount according to the invention.

FIG. 4 shows a second embodiment of a mount according to the invention, which substantially corresponds to the first embodiment according to FIG. 3. Therefore, analogous parts are provided with the same reference signs in FIG. 4 as in FIG. 3, but increased by 100. Furthermore, the mount 228 according to FIG. 4 will only be described in the following to the extent that it differs from the mount 128 according to FIG. 3, with reference otherwise hereby being expressly made to the description of the mount according to FIG. 3.

The mount 228 primarily differs from the mount 128 in that a single holding-force generation unit 260 is provided, which is mounted on the main body 250 so as to be rotatable about an axis X that extends in parallel with the vertical axis Z. The holding-force generation unit 260 comprises two cams 260*a* and 260*b*, which interact with the rams 256 and 258. On account of this arrangement, the rams 256 and 258 do not act from the outside in, as in the embodiment according to FIG. 3, but from the inside out. Therefore, the boundary walls 252*a* and 254*a* of the recesses 252 and 254, against which the rams 256 and 258 press the strands 214 and 216, are therefore formed on parts of the main body 250 that are arranged on the side of the strands 214 and 216 that is further away from the longitudinal axis A. Analogously, the ridges 252*b* and 254*b* are arranged on the side of the strands 214 and 216 that is nearer to the longitudinal axis A. Lastly, the cover wall 264 is also made up of two parts.

The holding-force generation unit 260 can be rotated in a manner known per se to a person skilled in the art. A detailed description will therefore be spared at this point.

In FIG. 4, the state of the holding-force generation unit 260 is shown below the longitudinal axis A, which allows the strand 216 to be inserted into the recess 254. For this purpose, the two cams 260*a* and 260*b* are aligned with the longitudinal axis A. In FIG. 4, however, the retaining state is shown above the longitudinal axis A, according to which the strand 214 is pressed against the boundary wall 252*a* and is therefore pressed under the cover wall 264 by the ram 256. This is made possible by rotating the holding-force generation unit 260 by 90° about the axis X such that the cam 260*a* assumes the position 260*a'*.

The invention claimed is:

1. A method for installing a tensioning element in an anchor block, comprising:

attaching the tensioning element to a mount, moving the mount towards the anchor block, inserting the tensioning element into a through-opening in the anchor block, fastening the tensioning element to the anchor block, wherein the mount is attached to the tensioning element at a spacing that is selected such that the length of the projection of the tensioning element, which is created by this spacing, on the side of the mount that is nearer to the anchor block is greater than the length of a portion of the tensioning element that is required in order to insert the tensioning element into the through-opening in the anchor block and to fasten the tensioning element to the anchor block.

2. The method according to claim 1, wherein the tensioning element comprises a strand, which is made up of a plurality of wires and is sheathed by a protective cover.

3. The method according to claim 1, wherein a guide unit is attached to the free end of the tensioning element, at least whilst the mount is being moved towards the anchor block.

4. The method according to claim 1, wherein the mount is moved towards the anchor block by a traction rope.

5. The method according to claim 4, wherein the guide unit is releasably connected to the traction rope.

6. The method according to claim 1, wherein the mount is configured for the attachment of at least two tensioning elements.

7. The method according to claim 6, wherein projections of the at least two tensioning elements are substantially the same length.

8. A mount for a tensioning element for carrying out the method according to claim 1 comprising:

a main body comprising an elongate recess for receiving the tensioning element, wherein the recess comprises an outlet at each of its two longitudinal ends, which is designed and intended to allow the tensioning element to enter the main body and to leave it again, and wherein the recess comprises an elongate opening in one of its longitudinal sides, which comprises a substantially linear portion that extends over the entire length of the main body, and a holding-force generation device, which is configured to generate a holding force that presses the tensioning element against a boundary wall of the recess.

9. The mount according to claim 8, wherein the holding-force generation device comprises an engagement element, which can move relative to the main body and is configured to enter into bearing engagement with the tensioning element and to press said tensioning element, whilst bearing against it, against a fixed wall portion of the recess in the main body.

10. The mount according to claim 8, wherein the holding-force generation device is configured to deflect the tensioning element out of its linear course.

11. The mount according to claim 8, wherein the main body also comprises a cover wall, which covers the recess at least in portions and in a manner in which it is adjacent to the fixed wall portion.

12. The mount according to claim 8, wherein the mount comprises at least two recesses.

13. The mount according to claim 12, wherein the two recesses are arranged substantially mirror-symmetrically with respect to the longitudinal direction of the mount.

14. The mount according to claim 13, wherein a common holding-force generation apparatus is assigned to the two recesses.

15. A combination of a mount according to claim 8 with at least one tensioning element that comprises a strand that is made up of a plurality of wires and is sheathed by a protective cover.

* * * * *